United States Patent [19]

Dudek et al.

[11] 4,450,136

[45] May 22, 1984

[54] CALCIUM/ALUMINUM ALLOYS AND PROCESS FOR THEIR PREPARATION

[75] Inventors: David M. Dudek, Salisbury; Mark A. Lambert, Barkhamsted, both of

[73] Assignee: Pfizer, Inc., New York, N.Y.

[21] Appl. No.: 356,580

[22] Filed: Mar. 9, 1982

[51] Int. Cl.[3] ..... C22C 1/00

[52] U.S. Cl. ..... 420/590; 420/415

[58] Field of Search ..... 75/135, 63, 65 R, 193 R; 420/590, 415

[56] References Cited

U.S. PATENT DOCUMENTS

| | | | |
|---|---|---|---|
| 2,257,988 | 10/1941 | Suchy et al. | 75/138 |
| 2,829,092 | 4/1958 | Andrieux et al. | 204/60 |
| 2,955,936 | 10/1960 | Deyrup | 75/135 |
| 3,272,619 | 9/1966 | Sweeney | 420/590 |
| 3,895,937 | 7/1975 | Gjosteen | 420/590 |
| 3,920,473 | 11/1975 | Sims | 136/65 |
| 3,939,009 | 2/1976 | Barnes et al. | 136/66 |
| 4,125,690 | 11/1978 | Bagshaw et al. | 429/226 |
| 4,233,070 | 11/1980 | McWhinnie et al. | 75/167 |
| 4,248,630 | 2/1981 | Balmuth | 420/590 |
| 4,286,984 | 9/1981 | Luyckx | 75/58 |

FOREIGN PATENT DOCUMENTS

| | | |
|---|---|---|
| 149310 | 11/1979 | Japan . |
| 1458016 | 12/1976 | United Kingdom . |

*Primary Examiner*—Peter D. Rosenberg

*Attorney, Agent, or Firm*—Charles J. Knuth; Peter C. Richardson; Harold W. Ordway

[57] ABSTRACT

A substantially homogeneous calcium/aluminum alloy having a calcium/aluminum atomic ratio of from about 60/40 to 80/20 and with useful and unexpected properties of brittleness, passivity to atmospheric moisture and low volatility is prepared by a process which comprises adding aluminum under an inert atmosphere to molten calcium at a temperature of from about 550° to 1100° C. and at a rate to prevent substantial solids formation in the melt during the addition. The molten alloy is converted to particulate solid either by melt atomization or by casting, crushing and grinding. Lead/calcium-/aluminum and tin/calcium/aluminum alloys are prepared by adding the calcium/aluminum alloy to the molten lead or tin, while calcium/aluminum/lithium alloy is prepared by adding lithium to the molten calcium/aluminum alloy.

13 Claims, No Drawings

CALCIUM/ALUMINUM ALLOYS AND PROCESS FOR THEIR PREPARATION

BACKGROUND OF THE INVENTION

This invention concerns calcium/aluminum alloys and their method of preparation.

Calcium and aluminum are used by the metallurgical industry for a variety of purposes. In ferrous metallurgy, for example, they are used extensively as addition agents, generally alone, but sometimes together or in combination with other elements such as lithium, for such functions as to deoxidize, desulfurize and degas steel and cast iron; to control the type and distribution of nonmetallic inclusions in steel; and to promote a uniform microstructure in gray iron.

Of particular importance today is their incorporation into lead, generally together with tin, to form the grids for maintenance-free auto batteries. The addition of calcium to the lead not only aids in fabrication of the grid but also markedly reduces gassing during battery operation, thus permitting the battery to be sealed. The presence of aluminum and tin further improves the mechanical and electrical properties of the grid.

The addition of calcium to other metals is especially problematical because calcium is highly reactive and the addition process is usually violent. For example, an explosive reaction accompanied by smoke and flare is encountered when pure calcium metal is added to molten steel. In addition, calcium is highly reactive with atmospheric moisture, turning to a hydrated form of lime within a short period of time. Because the metal is very ductile, it is not easily pulverized for use in such as gaseous injection processes.

Certain means of alloying calcium with aluminum are known. Thus, for example, the reduction of calcium oxide by molten aluminum is employed in U.S. Pat. Nos. 2,257,988 and 2,955,936 to prepare such an alloy containing a minor proportion of calcium, while the electrolysis of a calcium aluminate dissolved in a molten bath of alkali, alkaline earth or magnesium metal halides, as described in U.S. Pat. No. 2,829,092, purportedly results in the alloy containing any proportion of calcium to aluminum. Such preparations are commercially impractical and expensive, however. Preparation of a powdered calcium/aluminum alloy containing from 15 to 35 weight percent calcium by direct combination of the two metals has been proposed in Japanese Kokai No. 149310/79; as disclosed, calcium is added to molten aluminum under a nitrogen or argon atmosphere and the resulting melt is stirred, cast and crushed. In this range of compositions and method of addition, the problems of calcium reactivity and solids precipitation during alloy formation are not encountered. U.S. Pat. No. 2,829,092 also suggests combining the elemental forms of the metals to produce the alloy, but the process details are not revealed. Therefore, despite such disclosures, the need still exists for a simple, inexpensive process for preparing a homogeneous calcium/aluminum alloy containing a major proportion of calcium which can be readily handled and used.

Prior preparations of tertiary and higher alloys containing calcium and aluminum generally have utilized separate addition of the calcium and aluminum rather than calcium/aluminum alloy. Thus, U.S. Pat. Nos. 3,920,473 and 3,939,009 disclose the preparation of lead/calcium/aluminum alloy for battery plate grids in which a molten alloy of lead and aluminum is mixed with a solid alloy of lead and calcium, the lead/calcium alloy being obtained by the addition of calcium hydride to molten lead. In British Pat. No. 1458016, the alloy is prepared by adding solid calcium below the surface of a lead/aluminum melt protected by a layer of aluminum and aluminum oxide to prevent oxidation of the calcium, while U.S. Pat. No. 4,233,070 discloses the preparation of the alloy by the simultaneous addition of calcium and aluminum to molten lead. In U.S. Pat. No. 4,125,690, lead/tin/calcium/aluminum alloy is prepared by adding a solid lead/calcium/aluminum alloy to molten lead and then adding solid tin.

U.S. Pat. No. 4,286,984 discloses an alloy of calcium and aluminum with iron and/or manganese obtained by either adding the iron and/or manganese to molten calcium/aluminum eutectic alloy or by adding calcium to molten iron/aluminum, manganese/aluminum or iron/manganese/aluminum alloy, but the preparation of the calcium/aluminum alloy is not revealed.

It is therefore a primary objective of the present invention to provide a calcium/aluminum alloy containing a major proportion of calcium which is readily handled and used, to provide a simple and inexpensive process for preparing such an alloy by direct combination of the calcium and aluminum in elemental form, and to employ the alloy thus produced in the preparation of ternary alloys with such as lithium, lead and tin.

SUMMARY OF THE INVENTION

It has now been found that substantially homogeneous calcium/aluminum alloys containing a major proportion of calcium can be prepared from the elemental forms of the constituents by the controlled addition of aluminum to molten calcium, and that, within a limited compositional range, the alloy so produced has an unexpected brittleness, passivity to atmospheric moisture and low volatility.

The present invention therefore entails a process for the preparation of a substantially homogeneous calcium/aluminum alloy having a calcium/aluminum atomic ratio of from about 60/40 to 80/20 which comprises adding elemental aluminum to molten elemental calcium under an inert atmosphere to obtain a melt of a desired composition, the temperature of the melt during the addition being maintained at from about 550° to 1100° C., the aluminum being added at a rate to prevent substantial solids formation in the melt during the addition.

In preferred embodiments of the process, the aluminum is in the form of particulate solid and the aluminum is added to a stream of the molten calcium at a ratio of calcium to aluminum substantially equal to that of the desired composition.

The process may further comprise converting the alloy to a particulate solid, either by crushing or grinding or by melt atomization. Preferably, the atomic ratio of calcium to aluminum in the alloy is about 65/35.

The present invention also entails solid calcium/aluminum alloy having a calcium/aluminum atomic ratio of from about 60/40 to 80/20, preferably about 65/35, and particularly a particulate alloy prepared by the present process. Such alloy may further contain from about 1 to 5 atomic percent lithium.

The present invention further entails a process for the preparation of lead/calcium/aluminum alloy which comprises adding calcium/aluminum alloy prepared by the present process to molten lead, and a process for the preparation of tin/calcium/aluminum alloy having a tin/(calcium plus aluminum) weight ratio of from about 2 to 8 which comprises adding the calcium/aluminum alloy prepared by the present process to molten tin.

DETAILED DESCRIPTION OF THE INVENTION

The success in preparing calcium/aluminum alloy by the present process is unexpected, despite the teaching of prior art processes such as Japanese Kokai No. 149310/79, since calcium is extremely reactive, especially in the molten condition. The properties of brittleness, passivity to atmospheric moisture and oxygen, and relative nonvolatility observed with the present alloy containing a major proportion of calcium are also very surprising since the malleable, reactive and volatile nature of calcium would be expected to dominate in such an alloy.

The substantially homogeneous passive calcium-/aluminum alloy of the present invention contains a major proportion, i.e., from about 60 to 80 atomic percent, of calcium as compared to a minor proportion, from about 40 to 20 atomic percent, of aluminum. Preferably, the alloy has an atomic ratio of calcium to aluminum of about that at the eutectic composition, namely, 65/35.

To prepare the alloy, the aluminum is added under an inert atmosphere to molten calcium at a temperature of from about 550° to 1100° C. at such a rate that substantial precipitation does not occur, i.e., the melt remains essentially a single phase, throughout the addition. By inert atmosphere is meant the atmosphere in contact with the melt normally provided by an inert gas such as argon, carbon dioxide or nitrogen in which the oxygen content is about 2 volume percent or less.

To minimize the energy input to the process, the wear on the process equipment, and the reactivity of the constituents, the aluminum is added to the melt at a temperature only slightly above that for incipient solids precipitation within the compositional range of the present alloy, i.e., from about 550° to 1100° C., preferably from about 550° to 900° C. Thus, if the addition is not controlled, localized concentration of aluminum in the melt causes precipitation of the high melting intermetallic compound $CaAl_2$ (calcium/aluminum atomic ratio of 33/67); since the precipitate does not readily redissolve, a nonhomogeneous alloy product then results. The possibility of this premature solids formation can be avoided by maintaining a substantially uniform melt, such as by controlling the rate of addition of the aluminum to the melt and through mixing.

The aluminum is added to the molten calcium either as a solid or as a melt, the preferred form being a particulate solid having an average particle size of from about 0.05 to 5 millimeters. The addition may be batchwise, in which case the appropriate amount of aluminum is added with stirring to a pool of molten calcium. Preferably, however, the aluminum is added continuously to a stream of molten calcium at a rate such that the relative ratio of calcium to aluminum is substantially equal to that of the desired composition.

Although the substantially homogeneous molten calcium/aluminum alloy may be used as such, it is normally converted to a solidified, preferably particulate, form. Such can be readily accomplished by casting and cooling the melt and then, since the solidified product is brittle, crushing and/or grinding the resultant solid to the desired size; such particulate alloy might have an average particle size of from about 0.05 to 5 millimeters for use in injection applications or of from about 5 millimeters to 15 centimeters in direct addition applications. Alternatively, the melt is converted to particulate solid by melt atomization in which the molten metal alloy is broken up by means of either gases or a jet stream of non-reactive liquid. The present process preferably uses gases, producing a particulate material having a spherical shape particularly useful for addition processes, such as lance injection systems, shot injection systems or those using powdered materials in wire form. Atomization with liquids is not as desirable, since it produces substantially irregularly shaped particles which do not flow as well. The particles produced by melt atomization normally have a particle size in the range of from about 0.05 to 5 millimeters.

The unusual passivity of the solid calcium/aluminum alloy of the present invention toward atmospheric moisture and oxygen makes this product unique. Thus, the composition is stable under atmospheric conditions at room temperature and consequently can be easily stored and handled without the need for a protective atmosphere. This is not the case with calcium metal, the reactivity of which greatly limits its use.

The present alloy is particularly effective for use in the preparation of ternary or higher alloys. For example, lead/calcium/aluminum alloys containing only minor amounts of calcium and aluminum are readily prepared by adding the calcium/aluminum alloy, preferably in solid form, to molten lead, preferably at a temperature slightly above the melting point of the lead, for example, from about 400° to 700° C., with minimum loss of calcium. Likewise, tin/calcium/aluminum alloys, especially those in which the weight ratio of the tin to the sum of the calcium and aluminum is in the range of from about 2 to 8, are readily prepared by adding the calcium/aluminum alloy, under ordinary atmospheric conditions when in solid form, to molten tin slightly above its melting point, for example, from about 300° to 600° C.

The calcium/aluminum alloy may also be used to prepare ternary alloys containing only minor amounts of the third element such as lithium. In this case, the minor element is preferably added, normally under an inert atmosphere, to the molten calcium/aluminum alloy at the completion of its preparation, although the minor metal might also be added simultaneously with the aluminum to the molten calcium during the preparation of the calcium/aluminum alloy. The final melt may then be converted to particulate form of various sizes by any of the processes described hereinbefore, the product lending itself for such uses as in deoxidizing and desulfurizing molten steel.

The following examples are merely illustrative and are not to be construed as limiting the invention, the scope of which is defined by the appended claims.

EXAMPLE 1

Calcium/Aluminum Alloy

A quantity of metallic calcium contained in a 12 in (305 mm) diameter by 36 in (914 mm) melting pot was melted and heated to 1700°–1800° F. (871°–982° C.) under an argon atmosphere in a preheated furnace, the melting requiring 50–60 minutes. The melting pot was then removed from the furnace and the molten calcium poured under a carbon dioxide shroud into a 12 in diameter by 22 in (559 mm) high mold previously flushed with carbon dioxide. As the calcium was poured, particulate aluminum in the form of clipped EC wire about 2 mm in diameter and 10 mm in length was simultaneously added through a 2 in (51 mm) diameter pipe to the stream of molten calcium at the point where the calcium melt entered the mold. The relative rate of the calcium and aluminum streams was that of the 65/35 calcium/aluminum atomic ratio eutectic composition with a slight excess of calcium to compensate for calcium loss. Some 78 lb (35.4 kg) calcium and 27 lb (12.25 kg) aluminum were so combined in 30–60 seconds. Following the addition, the resultant melt was stirred 15 seconds and then allowed to cool 30–40 minutes. The resulting solid was tapped from the mold and crushed. A series of 18 consecutive preparations conducted as described resulted in an average yield of 89.2 lb (40.4 kg) of a substantially homogeneous calcium/aluminum alloy having an average calcium/aluminum atomic ratio of 68/32.

The product was crushed with a hammer to a particle size of less than 15 cm for use in lead addition. It may also be readily crushed in a jaw crusher or other means of mechanical attrition to final average particle size of about 5 mm. Alternatively, the molten alloy may be gas atomized using argon or other inert gas to obtain a solid particulate having an average particle size of about 50 microns.

EXAMPLE 2

Calcium/aluminum alloy at various calcium-/aluminum atomic ratios was prepared as in Example 1 and then evaluated for brittleness and atmospheric passivity.

To evaluate the alloy passivity, a sample of the alloy was crushed, and 3 to 4 pieces with a particle size of about 3 millimeters were added to 25 ml distilled water. The gassing and dissolution of the sample were observed with the results indicated below:

| Alloy | Ca/Al Atomic Ratio | Brittle | Passivity |
|---|---|---|---|
| 1 | 58/42 | yes | no gassing |
| 2 | 65/35 | yes | no gassing |
| 3 | 82/18 | yes | slight gassing for 5 minutes, then passive |
| 4 | 98/2 | no | gassed vigorously, dissolved in 2 minutes |

Alloys 1, 2 and 3 were judged brittle and passive, while alloy 4 was malleable and highly reactive.

EXAMPLE 3

Calcium/Aluminum/Lithium Alloy

To 100 kg of molten calcium/aluminum alloy containing 69 kg calcium and 31 kg aluminum (calcium-/aluminum atomic ratio 60/40) at 800° C. is added with stirring over a 15-minute period 590 g (3 atomic percent) metallic lithium. The resulting melt is stirred an additional 15 minutes and then gas atomized using argon to yield a passive and brittle particulate calcium-/aluminum/lithium alloy having an average particle size of about 50 microns.

EXAMPLE 4

Lead/Calcium/Aluminum Alloy

To 1000 kg molten lead at 550°–600° C. is added 2 kg of crushed solid calcium/aluminum alloy having a calcium/aluminum atomic ratio of 65/35 and prepared as in Example 1. The resulting melt is stirred for 15 minutes to distribute the calcium/aluminum alloy evenly in the lead and the lead is then cast in a battery grid casting machine.

EXAMPLE 5

Tin/Calcium/Aluminum Alloy

To 100 kg molten tin at 550°–600° C. is added with stirring 20 kg calcium/aluminum alloy of calcium-/aluminum atomic ratio 65/35 prepared by the process of Example 1. The melt is stirred an additional 15 minutes and then cast in molds.

EXAMPLE 6

Lead/Tin/Calcium/Aluminum Alloy

To 1000 kg molten lead at 400°–450° C. is added with stirring 10 kg of the tin/calcium/aluminum alloy of Example 5, either in molten form or in solid form. The resulting melt is stirred an additional 15 minutes and cast on a water-cooled grid-casting machine having an enclosed delivery system of the type conventionally used for casting 6 percent antimony/lead grids.

We claim:

1. A process for the preparation of a substantially homogeneous passive calcium/aluminum alloy having a calcium/aluminum atomic ratio of from about 60/40 to 80/20, which comprises adding elemental aluminum to molten elemental calcium under an inert atmosphere to obtain a melt of a desired composition, the temperature of said melt during said addition being maintained at from about 550° to 1100° C., said aluminum being added at a rate to prevent substantial solids formation in said melt during said addition.

2. The process of claim 1 wherein said aluminum is in the form of particulate solid.

3. The process of claim 1 wherein said aluminum is added to a stream of said molten calcium at a ratio of calcium to aluminum substantially equal to that of said desired composition.

4. The process of claim 1 which further comprises converting said alloy to particulate solid.

5. The process of claim 4 wherein said alloy is converted to particulate form by crushing or grinding.

6. The process of claim 4 wherein said alloy is converted to particulate form by melt atomization.

7. The process of claim 1 or 4 wherein said ratio is about 65/35.

8. Particulate calcium/aluminum alloy prepared by the process of claim 4.

9. Solid calcium/aluminum alloy having a calcium-/aluminum atomic ratio of from about 60/40 to 80/20, said alloy being brittle, relatively nonvolatile and essentially nonreactive to atmospheric moisture.

10. The alloy of claim 8 or 9 having a calcium-/aluminum atomic ratio of about 65/35.

11. The alloy of claim 8 or 9 further containing from about 1 to 5 atomic percent lithium.

12. A process for the preparation of lead/calcium-/aluminum alloy, which comprises adding said alloy prepared by the process of claim 1 to molten lead.

13. A process for the preparation of tin/calcium-/aluminum alloy having a tin/(calcium plus aluminum) weight ratio of from about 2 to 8, which comprises adding said alloy prepared by the process of claim 1 to molten tin.

* * * * *